US006263771B1

(12) United States Patent
Strauch

(10) Patent No.: US 6,263,771 B1
(45) Date of Patent: Jul. 24, 2001

(54) FORCE TRANSMISSION STRUCTURE ESPECIALLY FOR A SCREWING WRENCH WITH MULTIPLE CORNERS

(75) Inventor: Martin Strauch, Wuppertal (DE)

(73) Assignee: Wera-Werk Hermann Werner GmbH & Co., Wuppertal (DE)

( * ) Notice: Subject to any disclaimer, the term of this patent is extended or adjusted under 35 U.S.C. 154(b) by 0 days.

(21) Appl. No.: 09/486,777

(22) PCT Filed: Jul. 13, 1999

(86) PCT No.: PCT/EP98/04338

§ 371 Date: May 19, 2000

§ 102(e) Date: May 19, 2000

(87) PCT Pub. No.: WO99/11436

PCT Pub. Date: Mar. 11, 1999

(30) Foreign Application Priority Data

Sep. 1, 1997 (DE) ..... 197 38 079

(51) Int. Cl.[7] ..... B25B 15/00
(52) U.S. Cl. ..... 81/436; 81/900
(58) Field of Search ..... 81/436, 460, 461, 81/900

(56) References Cited

U.S. PATENT DOCUMENTS 5,284,075 * 2/1994 Strauch et al. ..... 81/436
5,873,290 * 2/1999 Chaconas ..... 81/436
6,016,727 * 1/2000 Morgan ..... 81/436

FOREIGN PATENT DOCUMENTS 0512248 11/1992 (EP) .
0630722 12/1994 (EP) .

* cited by examiner

*Primary Examiner*—James G. Smith
(74) *Attorney, Agent, or Firm*—Martin A. Faber

(57) ABSTRACT

The invention relates to a force transmission structure especially for a screwing wrench with multiple corners. The invention is configured for an inner multiple cornered mating profile especially for a screw with a six cornered inner case profile. The force transmission structure is constructed with equal multiple corners whose flanks border one another in a circumferential direction. The diameter contour line of each flank possesses two convex curvature lines which are interspaced and the interspacing area recoils between the curvature lines and connecting tangent lines, the tangent lines consisting of both crowns of the convex curvature lines. In order to transmit high levels of torque, the invention provides that the section of the curvature lines between the crowns and the multiple corners is either rectilinear of its curvature is flatter than that of the convex curvature line.

10 Claims, 7 Drawing Sheets

Fig: 2
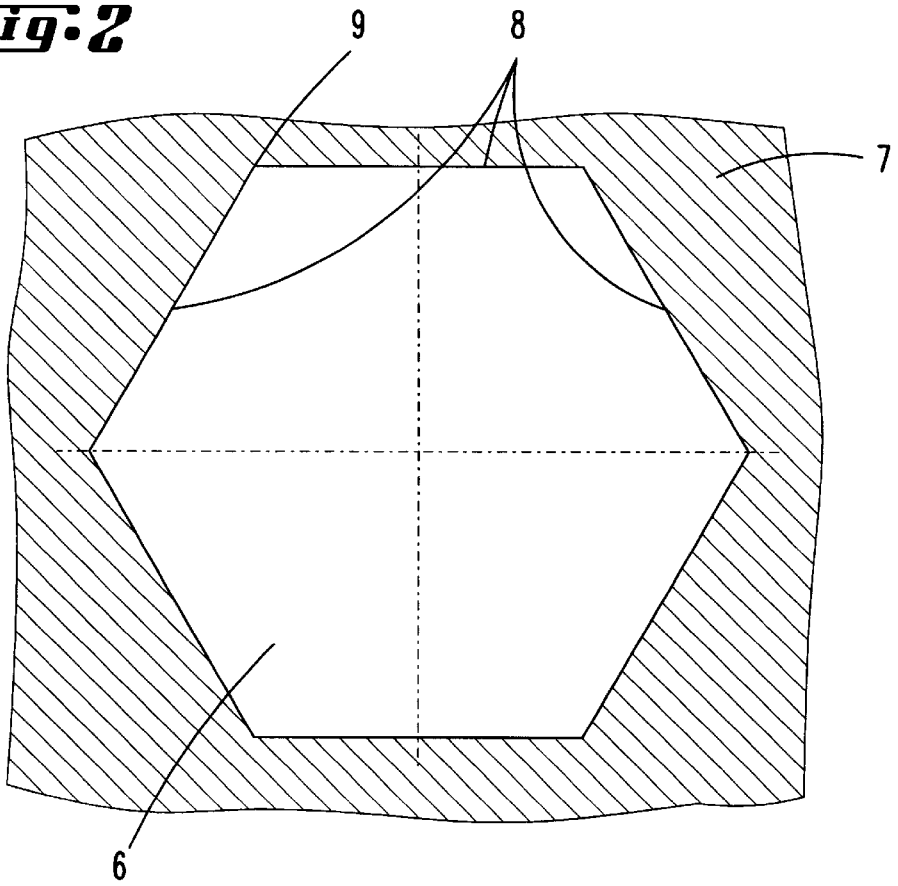
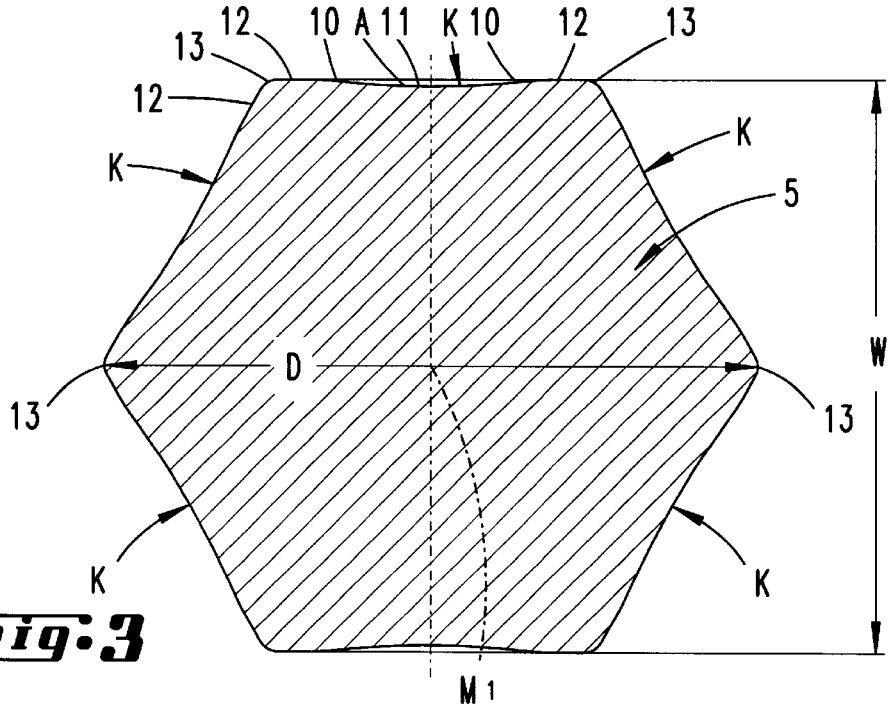
Fig: 3

FORCE TRANSMISSION STRUCTURE ESPECIALLY FOR A SCREWING WRENCH WITH MULTIPLE CORNERS

FIELD AND BACKGROUND OF THE INVENTION

The invention relates to a force-transmission profile, in particular on a polygonal screwing tool, for a polygonal-socket mating profile, in particular for a hexagon-socket profile of a screw, having circumferentially similarly formed flanks which adjoin one another at polygon corners, the cross-sectional contour line of each flank having two spaced-apart, convexly extending lines of curvature, and the spacing region between the lines of curvature extending in a set back manner in relation to the tangent connecting the two vertices of the convex lines of curvature.

A force-transmission profile of the type in question is known from EP 0 512 248, in which the spaced-apart, convexly extending lines of curvature intersect one another to form a polygon corner in each case. This means that the convex lines of curvature, starting from the spacing regions and opening out into the polygon corners, are curved uniformly. Because of this formation, a force-transmission profile configured in this way allows a higher torque to be transmitted than known force-transmission profiles.

SUMMARY OF THE INVENTION

The object underlying the subject matter of the invention is to configure a force-transmission profile of the type mentioned such that it is possible to transmit even higher torques without this resulting in the force-transmission profile slipping.

This object is achieved first and foremost with a force-transmission profile wherein the contour-line section between vertex and polygon corner is of shallower curvature than the convexly extending line of curvature or is rectilinear.

Such a configuration gives a force-transmission profile, in particular on a polygonal screwing tool, which is distinguished by increased torque transmission without slipping. In relation to the known solution mentioned in the introduction, in which the convex lines of curvature of two adjacent flanks intersect with formation of a polygon corner, the vertex of the convexly extending line of curvature is adjoined by a contour-line section which is either of shallower curvature or is rectilinear, this being associated with the advantage that there is an increase in the cross section of the force-transmission profile in the corner region. Nevertheless, the plough effect is not relinquished, this consisting in the fact that, from a certain limit torque, the polygon regions of the force-transmission profile engage against the flanks of the polygonal socket and there, with the action of a plough, dig into the inner edge and push the material of the screw head in front of them into the region of the non-convexly formed spacing region. Specifically, the geometrical relationships here are such that the spacing between the vertex and the polygon corner is less than that between vertex and transverse centre line of the force-transmission profile. The polygon corner may then be sharp-edged or slightly rounded. If the contour-line section extends in rectilinear manner, the relevant radius is approximately 0.2 mm, whereas a radius of approximately 0.1 mm should be selected if the contour-line section is of shallow curvature. These slightly rounded formations serve, in particular, for avoiding burr during production. This measure has also proven advantageous in production terms if the force-transmission profile is cold-drawn in the form of a wire. It is also provided that the outer contour-line sections are located on the tangent. This relates to the rectilinear contour-line sections. It is then provided according to the invention that the radius of curvature of the convexly extending line of curvature corresponds approximately to half the width across flats. In this case, the centre point of the convexly extending line of curvature is offset from the centre point of rotation of the force-transmission profile by approximately a fifth of the width across corners. If a contour-line section of shallow curvature is selected, then it is favourable for the outer contour-line section to have a radius of curvature of the magnitude of the width across flats, and for the centre point to be spaced apart from the transverse centre line by approximately the same distance as the centre point of the convexly extending line of curvature. The relevant spacing region between the convex lines of curvature does not extend in a convex manner. Rather, the spacing region between the convex lines of curvature is a concave curve which runs smoothly into the lines of curvature. This means that there are no edges, corners or protrusions which would impair the plough effect during operation in the limit region. The radius of the concave curve is selected to be larger than the width across flats. The radius favourably corresponds approximately to one and a half times the width across flats.

BRIEF DESCRIPTION OF THE DRAWINGS

Two exemplary embodiments of the invention are explained hereinbelow with reference to the drawings, in which:

FIG. 2 shows a vastly enlarged illustration of a cross section through the screw head in the region of the hexagon socket, FIG. 3 shows a likewise vastly enlarged illustration of a cross section through the force-transmission profile of the screwdriver.

DETAILED DESCRIPTION OF PREFERRED EMBODIMENT

Figure 1:
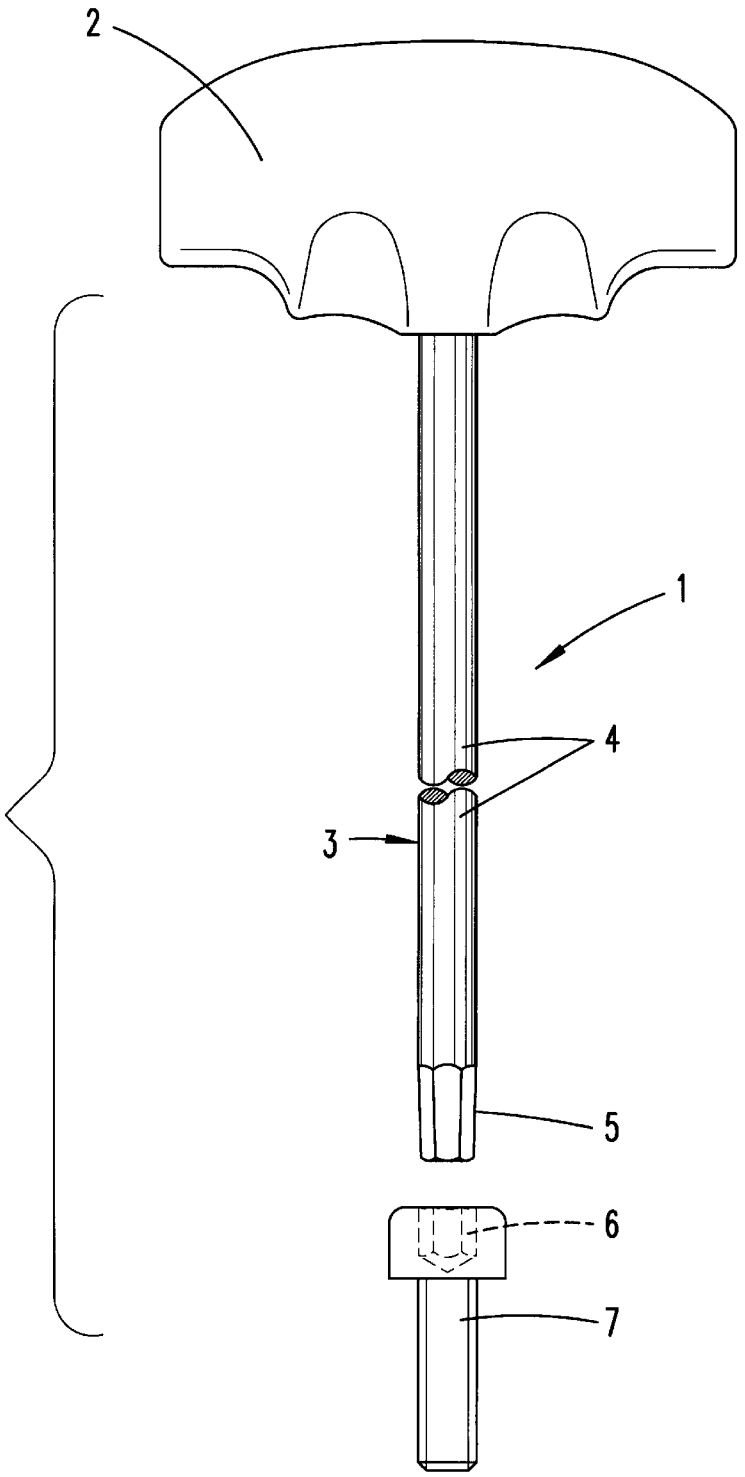
FIG. 1 shows a view of a polygonal screwing tool, which is configured in the form of a screwdriver and is intended for hexagon-socket screws, and a hexagon-socket screw arranged coaxially therewith.

Both exemplary embodiments form a constituent part of a polygonal screwing tool 1 illustrated in FIG. 1. Said screwing tool is configured as a screwdriver which has a handle 2 with a stem 3 which is fitted in the handle 2 and cannot rotate in relation to the same. Said stem has a cross-sectionally cylindrical shank 4 which, at its end, forms a hexagonal transmission profile 5 configured as an externally polygonal member. Said transmission profile constitutes the operating end of the screwdriver and is suitable for engaging in the hexagon-socket profile 6 of a screw 7.

In specific terms, the hexagon-socket profile 6 is made up of rectilinearly extending hexagon-socket surfaces 8 such that in each case two adjacent hexagon-socket surfaces 8 meet at an edge 9. The spacing between two opposite hexagon-socket surfaces which extend parallel to one another is standardized and slightly larger than the width W across flats of the force-transmission profile 5.

While the screw 7 provides rectilinear hexagon-socket surfaces 8, the force-transmission profile according to the first embodiment, in FIGS. 3 to 6, has, on each flank, a cross-sectional contour line K which has two spaced-apart, convexly extending lines of curvature 10. The spacing region 11 between these two lines of curvature 10 runs in a set back manner in relation to the tangent T connecting the two vertices S of the convex lines of curvature. This spacing region 11 does not extend in a convex manner, but is a concave curve A which runs smoothly into the lines of curvature 10. The radius x of the concave curve A is greater than the width W across flats and corresponds approximately to one and a half times the width W across flats. The radius of curvature y of the convexly extending line of curvature 10 corresponds in this case to approximately half the width W across flats. This means that the centre point M of the convex line of curvature is thus level with a diameter line D connecting two opposite polygon corners. Furthermore, the centre point M is offset in relation to the centre point of rotation M1 of the force-transmission profile 5 by approximately a fifth of the width across corners.

Figure 6:
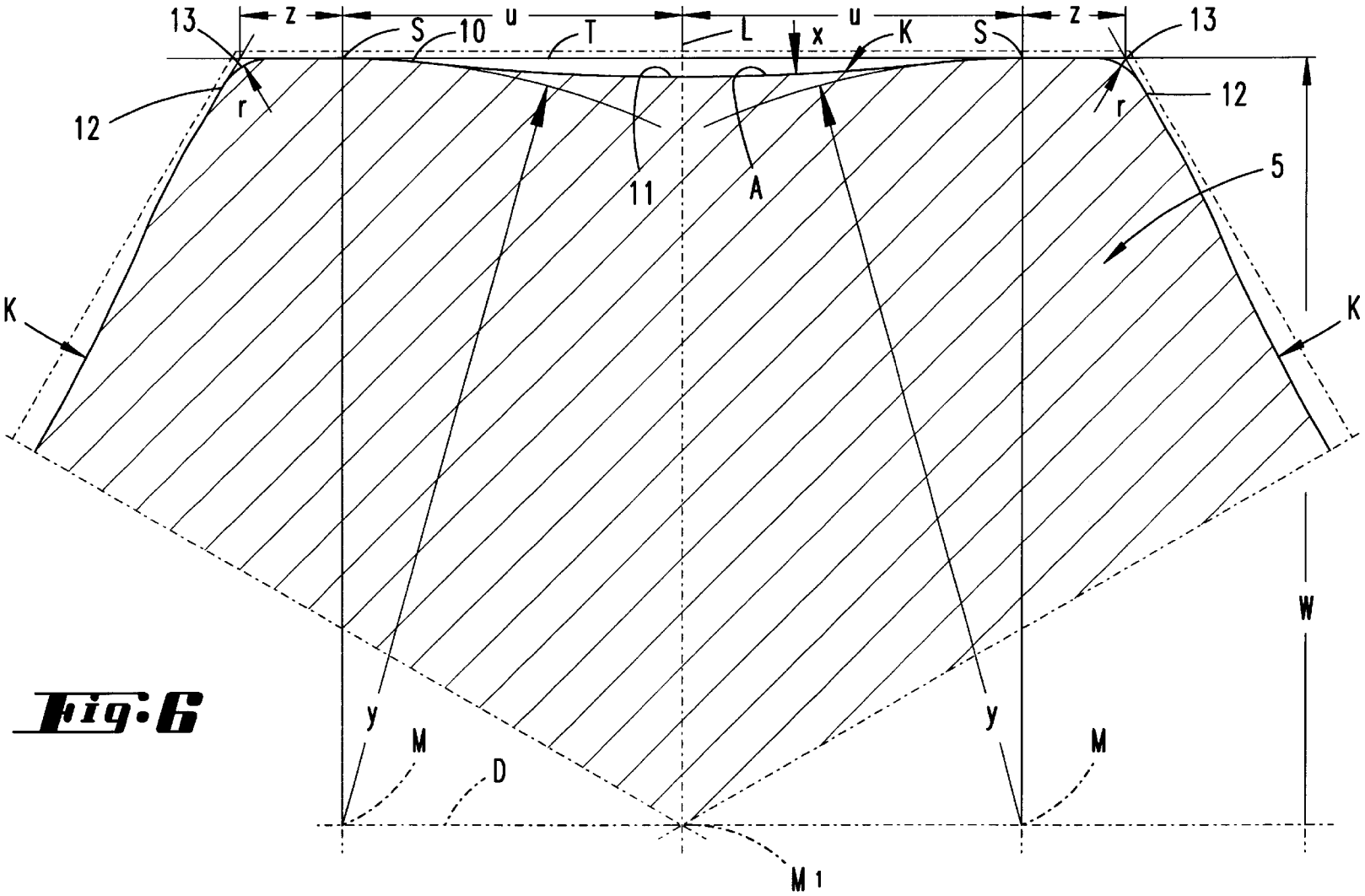
FIG. 6 shows a further-enlarged, part-sectional illustration with the geometrical relationships being indicated.

According to the first embodiment, in FIGS. 3 to 6, the contour-line section 12 between vertex S and polygon corner 13 extends in rectilinear manner, such that the two contour-line sections 12 are located on the tangent T and, accordingly, constitute part-sections of the same. By the arrangement of the centre point M at a corresponding spacing from the axis of rotation M1, there results that the spacing z between the vertex S and the polygon corner 13 is less than the spacing u between vertex S and the transverse centre line L of the force-transmission profile 5, said transverse centre line running perpendicularly to the tangent T and passing through the centre point of rotation M1. FIG. 6 then shows that the vertex S is level with the point of intersection between the line of curvature 10 and the normal to the diameter line D which passes through the centre point M.

It can also be seen from FIG. 6, in particular, that the polygon corner 13 is slightly rounded. The relevant radius r is approximately 0.2 mm.

Figure 4:
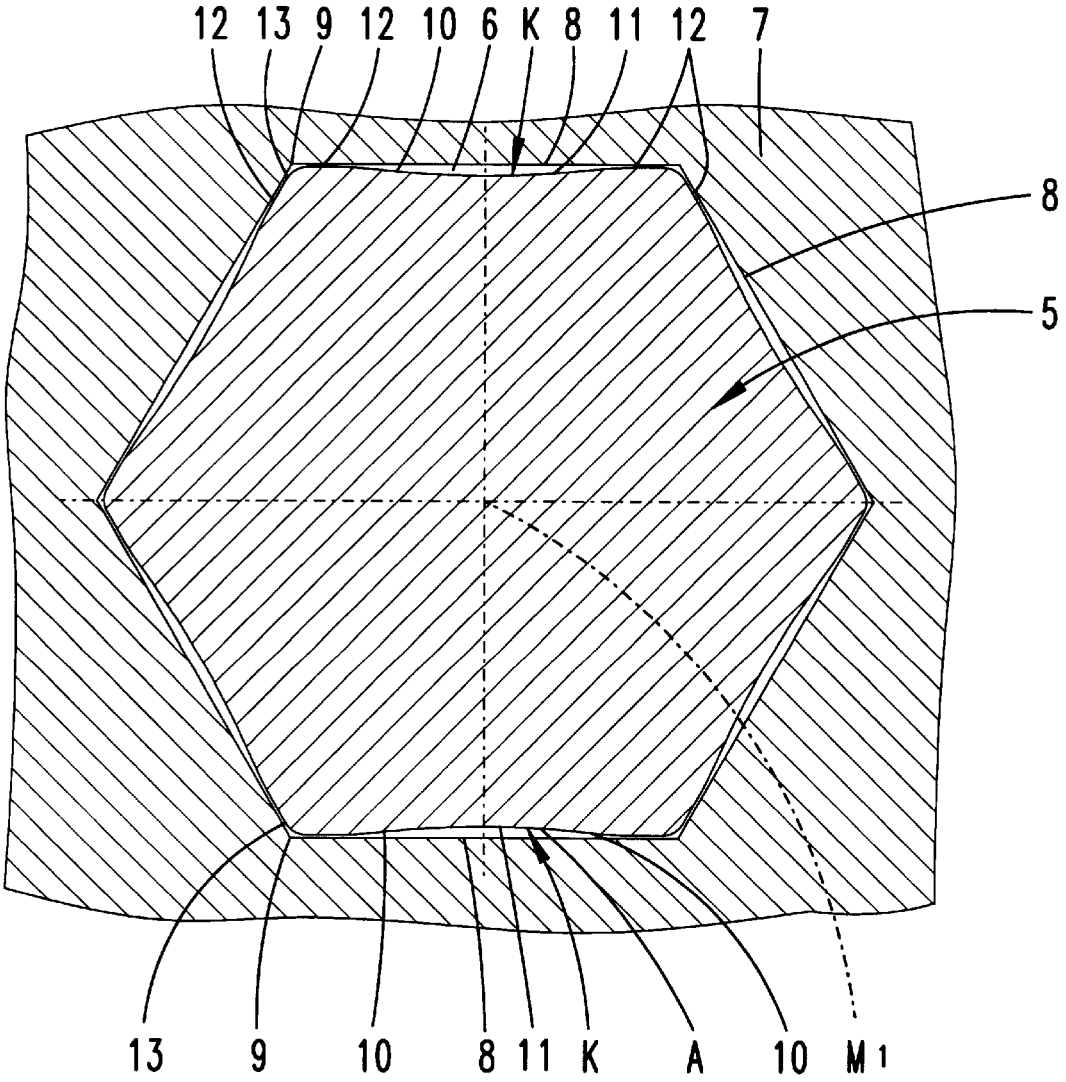
FIG. 4 shows the cross section through the screw head with the operating end of the screwdriver fitted into the hexagon socket of the screw head but not exerting any torque thereon.
Figure 5:
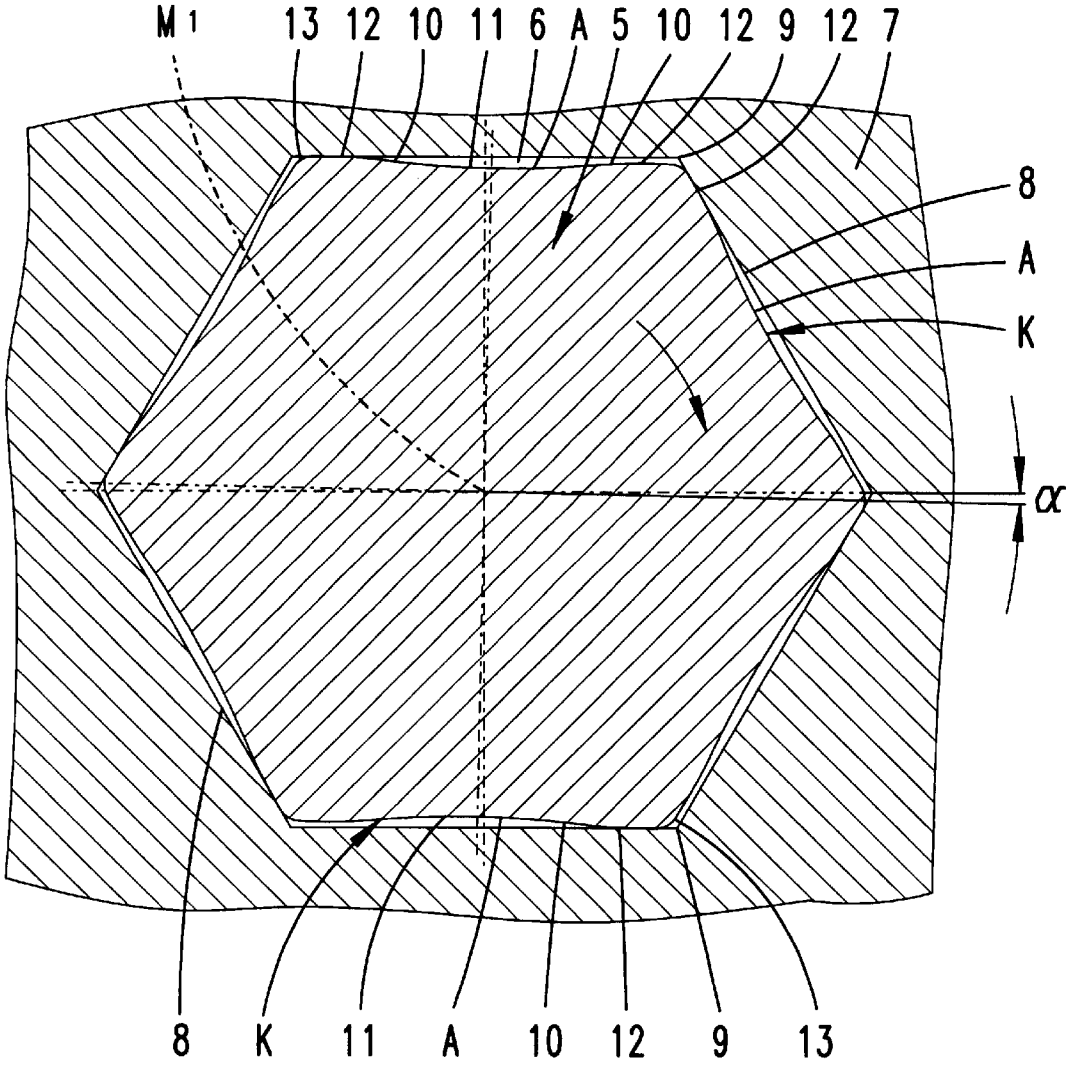
FIG. 5 shows the illustration as in FIG. 4 in a position in which the screw is carried along by the turning action of the screwdriver.

If the screw 7 is to be carried along by means of the force-transmission profile 5, as is illustrated in FIG. 4, then the force-transmission profile 5 first of all has to be fitted in a positively locking manner into the hexagon-socket profile 6. The force-transmission profile 5 may then be turned in the direction of the arrow, that is to say in the clockwise direction. This results in a slight relative rotation of the screw 7 and the force-transmission profile 5 through the angle alpha relative to one another. With a certain deformation of the hexagon-socket surfaces 8 being taken into account, a supporting surface of large dimensions is achieved. The corner regions of the force-transmission profile 5 act on the hexagon-socket surfaces 8 with a large lever arm and ensure high torque transmission. If the limit region in force-transmission is reached, the corner regions of the force-transmission profile 5 dig into the hexagon-socket surfaces 8 of the screw 7 and displace material radially inwards, which counteracts slipping of the force-transmission profile 5 in the hexagon-socket profile 6.

Figure 7:
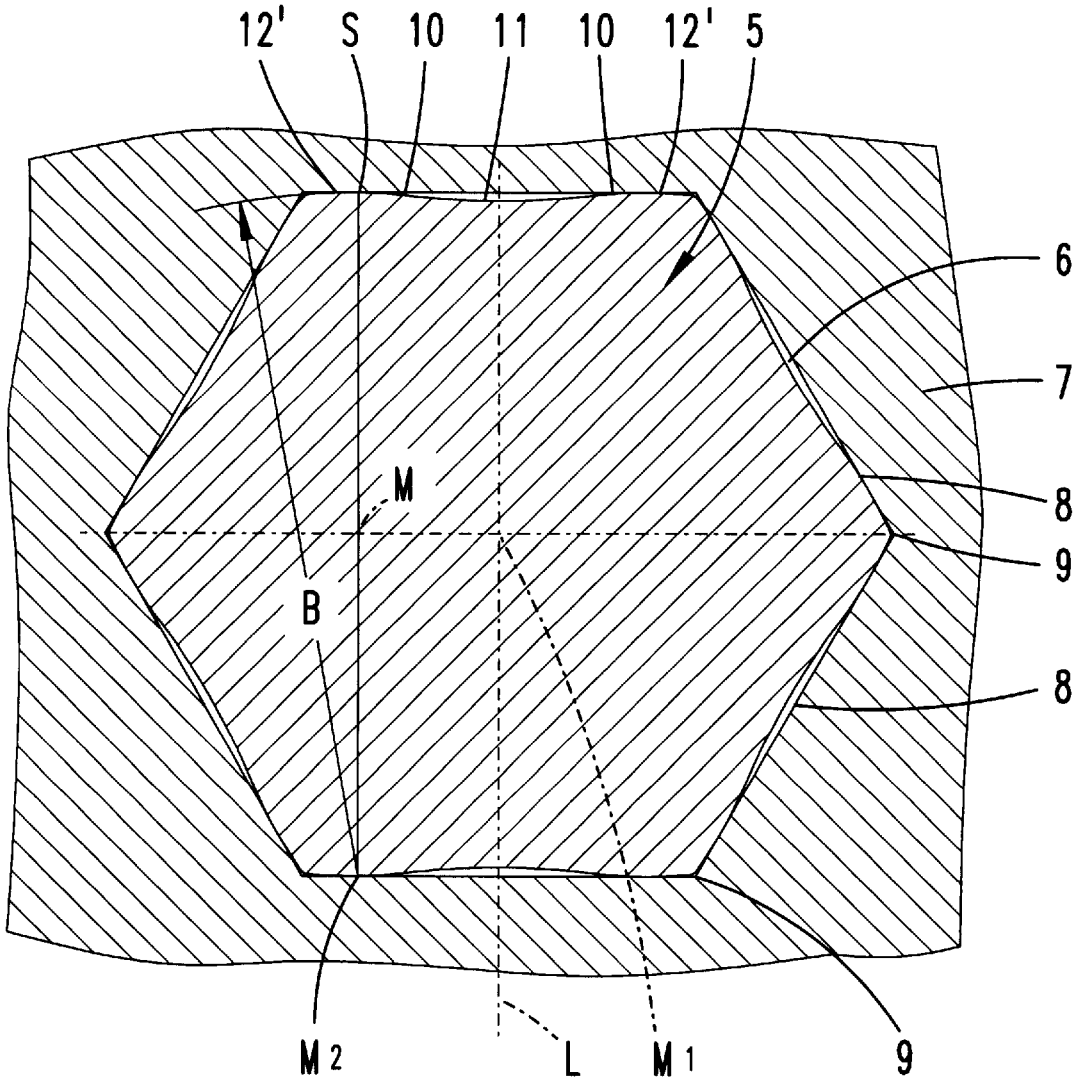
FIG. 7 shows a cross section through the force-transmission profile according to the second embodiment.
Figure 8:
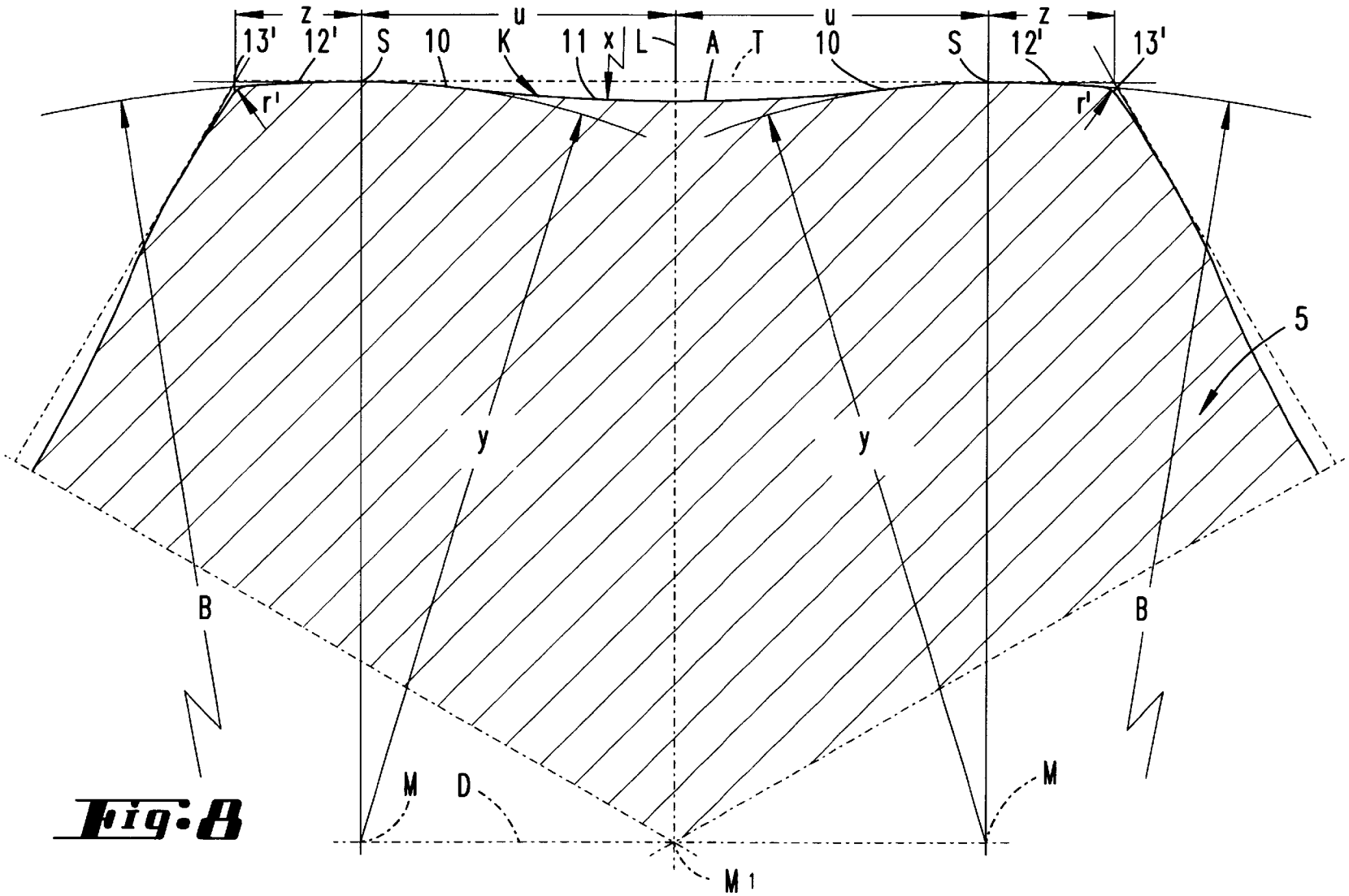
FIG. 8 shows an enlarged detail of FIG. 7, likewise indicating the geometrical relationships.

In the second embodiment, which is illustrated in FIGS. 7 and 8, the same parts have the same designations. In contrast, then, the contour-line section 12' between vertex S and polygon corner 13' extends with shallower curvature than the convex line of curvature 10. The contour-line section 12' has a radius of curvature B of the magnitude of the width W across flats. Furthermore, the centre point M2 is spaced apart from the transverse centre line L by approximately the same distance as the centre point M of the convexly extending line of curvature 10.

A further deviation compared with the first embodiment consists in that, in this case, the radius r' in the region of the polygon corner 13' is smaller and is approximately 0.1 mm, both exemplary embodiments being based on a width across flats of 6 mm.

The second embodiment functions in the same way as has been described for the first embodiment.

What is claimed is:

1. A polygonal screwing tool for a polygonal-socket, comprising:

a plurality of flanks arranged circumferentially around a work end of the tool and adjoining one another in a configuration approximating an encircling polygon, the flanks adjoining one another at corners of the polygon; and wherein, proceeding circumferentially around the tool, each of the flanks has a central concave section disposed between two outer convex sections which extend to opposed edges of the flank, each of the convex sections having a curvature about radii of differing length such that a shorter-radius of curvature defines a portion of the convex section contiguous to the central concave section and a longer radius of curvature defines a portion of the convex section contiguous an edge of the flank.

2. A tool according to claim 1, wherein, in any one of the flanks, curvature of the longer radius of curvature approaches a rectilinear form, a change in curvature between curvatures defined by the curvature of the shorter radius and the curvature of the longer radius occurs at a vertex located essentially on the encircling polygon, and a spacing between vertex and polygon corner is less than a distance between vertex and a center of the concave section.

3. A tool according to claim 1, wherein, in any one of the flanks, an edge of the flank at the polygon corner is rounded.

4. A tool according to claim 1, wherein, in any one of the flanks, in a portion of the flank having the curvature defined by the larger radius of curvature, a tanget to the curvature is parallel to a side of the encircling polygon.

5. A tool according to claim 1, wherein the encircling polygon is a hexagon, and the shorter radius of curvature is approximately equal to half a width of the polygon measured between opposed sides thereof.

6. A tool according to claim 1, wherein the encircling polygon is a hexagon, and, in any one of the flanks a center point of the longer radius of curvature is displaced from a center of the encircling polygon by approximately a fifth of a diameter of the polygon measured between opposed corners of the polygon.

7. A tool according to claim 1, wherein the encircling polygon is a hexagon, and in any one of the flanks, the longer radius of curvature is approximately equal to the diameter of the encircling polygon measured between opposed sides thereof, and center points for respective ones of the radii of curvature are displaced approximately equally from a centerline of the polygon extending between opposed sides of the polygon.

8. A tool according to claim 1, wherein, in any one of the flanks, the curvature of the concave section runs smoothly into the curvature of each of the convex sections.

9. A tool according to claim 8, wherein the encircling polygon is a hexagon, and, in any one of the flanks, the shorter radius of curvature is larger than the width of the polygon measured between opposed sides thereof.

10. A tool according to claim 9, wherein the shorter radius of curvature is approximately equal to one and a half times the width of the polygon measured between opposed sides thereof.

* * * * *

UNITED STATES PATENT AND TRADEMARK OFFICE

CERTIFICATE OF CORRECTION

PATENT NO. : 6,263,771 B1
DATED : July 24, 2001
INVENTOR(S) : Martin Strauch

It is certified that error appears in the above-identified patent and that said Letters Patent is hereby corrected as shown below:

Title page,
Item [22], PCT Filed:
change "Jul. 13, 1999" to -- Jul. 13, 1998 --

Signed and Sealed this

Fifteenth Day of October, 2002

*Attest:*

*Attesting Officer*

JAMES E. ROGAN
*Director of the United States Patent and Trademark Office*